US005257738A

United States Patent [19]

Sköld

[11] Patent Number: 5,257,738

[45] Date of Patent: Nov. 2, 1993

[54] SUPPLY AIR TERMINAL DEVICE

[75] Inventor: Göthe Sköld, Gällivare, Sweden

[73] Assignee: Nordsvenska Industrikonstruktioner AB, Gallivare, Switzerland

[21] Appl. No.: 793,419

[22] PCT Filed: Jul. 11, 1990

[86] PCT No.: PCT/SE90/00489

§ 371 Date: Jan. 8, 1992

§ 102(e) Date: Jan. 8, 1992

[87] PCT Pub. No.: WO91/01470

PCT Pub. Date: Feb. 7, 1991

[30] Foreign Application Priority Data

Jul. 20, 1989 [CH] Switzerland ..... 8902578

[51] Int. Cl.[5] ..... F24D 19/06

[52] U.S. Cl. ..... 237/79; 454/287

[58] Field of Search ..... 165/59, 121; 237/70, 237/78 A, 79; 454/287, 288

[56] References Cited

U.S. PATENT DOCUMENTS 1,515,963 11/1924 Morrell ..... 237/79
1,630,705 5/1927 King ..... 237/79
1,745,828 2/1930 Barnes ..... 237/79
1,916,355 7/1933 Bennett ..... 237/79 X
2,477,824 8/1949 Reiss ..... 454/287 X
2,489,187 11/1949 Kindt ..... 237/79 X

FOREIGN PATENT DOCUMENTS 77049 6/1953 Norway ..... 237/70
494055 10/1938 United Kingdom ..... 237/79

*Primary Examiner*—Harold Joyce
*Attorney, Agent, or Firm*—Cushman, Darby & Cushman

[57] ABSTRACT

A supply air terminal device for supplying fresh air to apartment buildings in particular. The device (1) is intended to be placed between a wall (100) and a radiator (20) and functions to cause fresh air, taken from outside, to pass along one side surface (21) of the radiator (20) before entering the apartment. The device (1) includes attachment devices (40, 50, 53 and fastener 30, 31) by which the radiator (20) is secured, via the supply air terminal device, to the wall (100). The radiator attachment includes hooked devices (4) mounted on the lower edge part of the device (1) and functioning to engage around the bottom edge (22) of the radiator (20). Mounted on the upper edge part of the device (1) are attachment devices (50) which are intended to engage the upper edge (23) of the radiator (20). The device (1) has a rear wall (20) in which holes (30) are provided for connecting the rear wall (2) to the wall (100) with the aid of fastener elements (31).

2 Claims, 2 Drawing Sheets

SUPPLY AIR TERMINAL DEVICE

BACKGROUND OF THE INVENTION

The present invention relates to a device attachable to a wall of a room and to a radiator in the room, for hangingly supporting a radiator from the wall and for providing ducting for directing air from outdoors, into heat exchange relation with the radiator, and out into the room.

In conjunction with supplying fresh air to apartment buildings, it is beneficial to use the type of supply air terminal device that is connected to the radiators installed in the building. Air supplied to the building is taken from outside the building and pass to the supply air terminal device through a delivery conduit, and the device forces the supply air to flow along one side of the radiator, before it leaves the device and enters respective rooms of the building.

Known devices of this kind are normally mounted on the rear side of the radiator, i.e. between the radiator and the inwardly facing surface of the outer wall. In this case, separate attachments are provided for the radiator and the supply air terminal device.

SUMMARY OF THE INVENTION

The object of the present invention is to provide a particularly simple and attractive supply air terminal device which will function as a radiator attachment at the same time.

In addition to the economic advantages afforded by the inventive device, it can be mentioned that both the device and radiator can be installed much easier than was earlier the case. Furthermore, the invention eliminates the occurrence of a gap between the inwardly facing surface of the wall and the terminal device.

BRIEF DESCRIPTION OF THE DRAWINGS

Exemplifying embodiments of the invention will now be described with reference to the accompanying drawings, in which.

DETAILED DESCRIPTION

Figure 1:
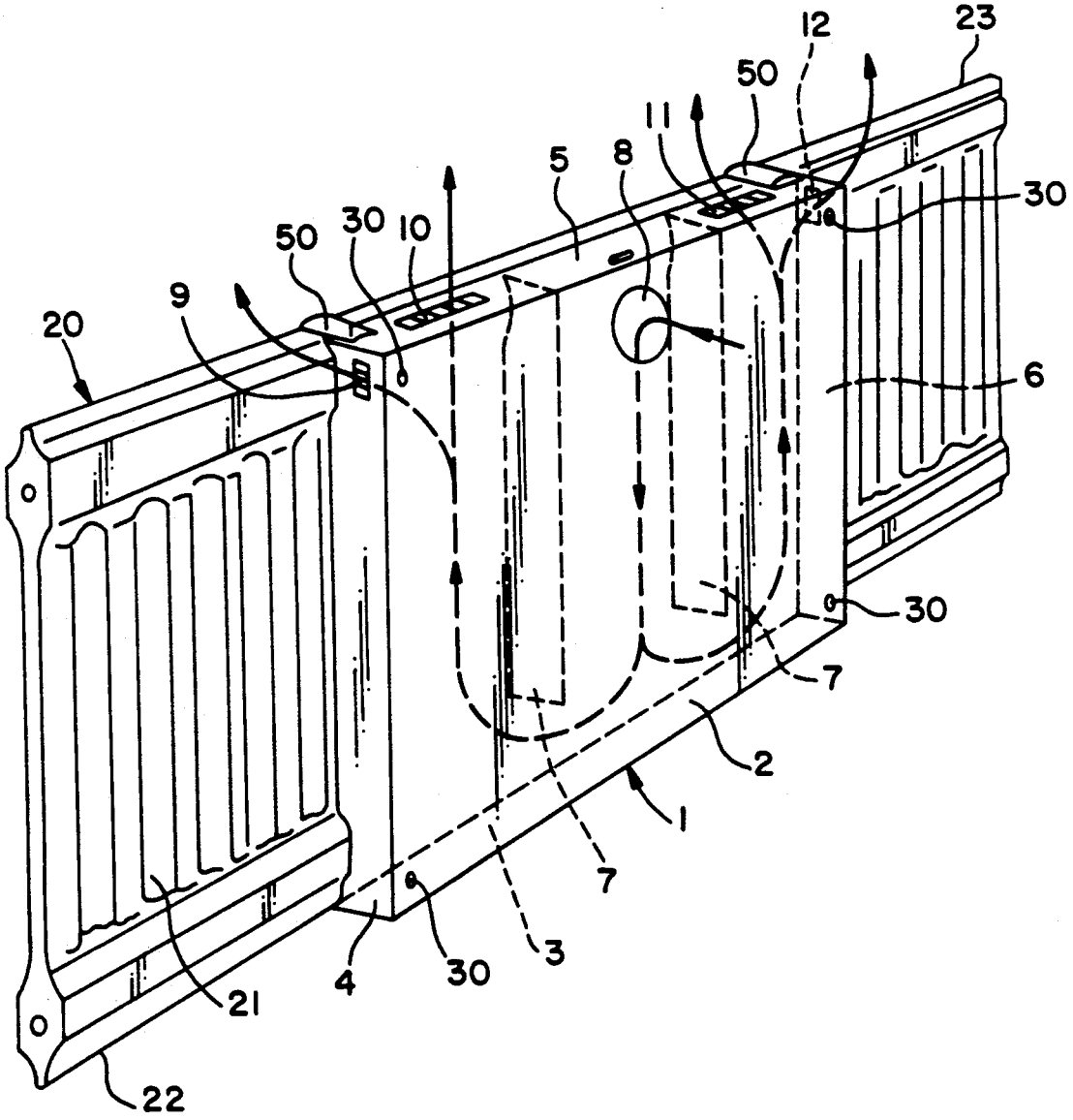
FIG. 1 is a perspective view, seen from the rear, of an inventive supply air terminal device which supports a radiator.
Figure 2:
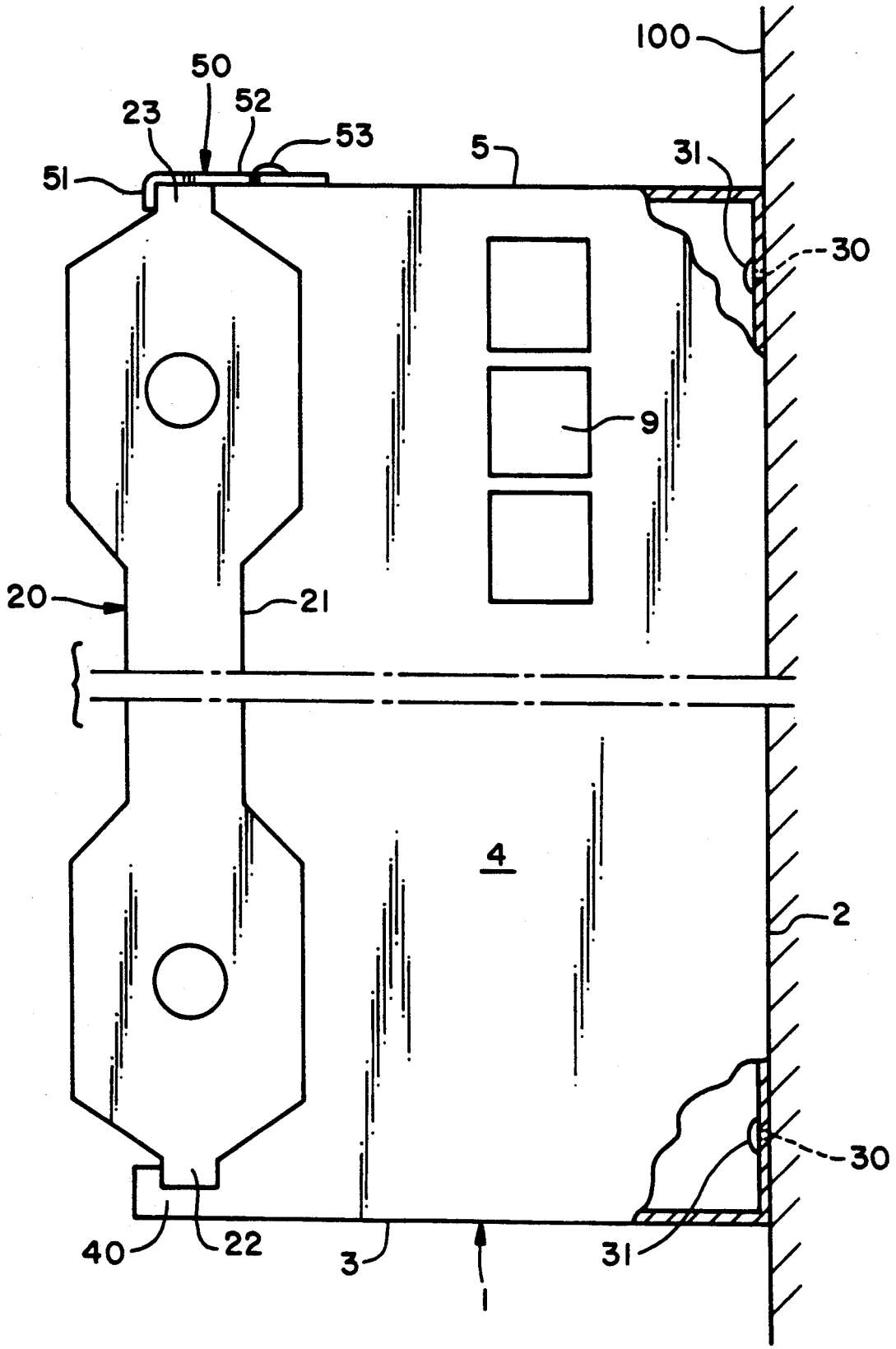
FIG. 2 is a schematic, partially broken side view of the supply air terminal device and the radiator mounted on a wall.

The supply air terminal device 1 includes a rear wall 2 and four side walls 3–6. A plurality of air-guide baffles 7 are normally disposed within the terminal device 1. The terminal device also has an inlet opening 8 for fresh air taken from outside the building, this fresh air being conducted to the inlet opening 8, for instance through a conduit or duct (not shown) provided in an outer wall.

As will be understood, the free edges of the side walls 3–6 are adapted to coincide with the configuration of the radiator 20 concerned.

The terminal device 1 also has a plurality of outlet openings 9–12, through which supply air, which flows along one side 21 of the radiator 20 while being heated by said radiator, enters the room in which the radiator is located.

The air flow through the terminal device 1 is arrowed in FIG. 1.

Although not shown, the terminal device 1 includes seals which effect sealing abutment with the radiator 20.

Furthermore, the terminal device 1 preferably includes a valve means (not shown) for controlling the flow of air through said device, and also a filter (not shown) for cleaning the fresh air taken into the device.

The rear wall 2 of the terminal device 1 has formed therein a plurality of holes 30 by means of which the device can be secured to a relevant wall surface 100 with the aid of appropriate fasteners, such as screws 31 for instance.

The lower edge part of the terminal device 1 is provided with a number of hooked devices 40 which receive and support the bottom edge 22 of the radiator 20. Two hooked devices 40 are normally sufficient for this purpose, and are disposed, for instance, on the vertical side walls 4 and 6 of the terminal device 1.

The terminal device 1 also includes a number of angled attachment devices 50, which function to anchor the upper edge 23 of the radiator 20. The attachment devices 50 include two legs 51 and 52 which extend substantially at right angles to one another. The one leg 51 engages around the upper radiator edge 23 and the other leg 52 is anchored to the upper side wall 5 of the terminal device 1 by means of a fastener, for instance a plate screw 53. Two such attachment devices 50 are normally sufficient.

As will be understood, the terminal device 1 is first fitted onto the wall surface 100 with the aid of the fastener screws 31, and connected therewith to the fresh air conduit. The bottom edge 22 of the radiator 20 is then placed in the hooked devices 40 on the terminal device 1. The upper edge 23 of the radiator 20 is then anchored by means of the attachment devices 50, which are fixed to the upper side wall 5 of the terminal device 1 by means of the screws 53. The radiator energy supply means can then be connected-up. Thus, the supply air terminal device 1 functions as a holder and as a radiator attachment, besides performing its normal function at the same time.

The invention is not restricted to the illustrated and described embodiment, since changes and modifications can be made within the scope of the following claims.

I claim:

1. A supply air terminal arrangement comprising:

a room having a wall between an interior space and outside, said wall having an opening provided therethrough communicating the interior space with outside;

a radiator disposed in said interior space, in heat exchange relation with said interior space;

a supply air terminal device comprising: a casing; fastener means mounting said casing to said wall; said supply air terminal device being disposed between said wall and said radiator; means defining an air inlet opening into said casing; said air inlet opening into said casing being disposed in communication with said opening through said wall, for admitting air from outside into said casing; means defining an air outlet opening from said casing into said room; means defining at least one baffled passageway through said casing from said air inlet opening to said air outlet opening; said passageway being located in proximity to said radiator, for heating air entering from outside, passing through said passageway and introduced into said room; and attachment means on said casing engaged with said radiator for effectively supporting said radiator via said casing from said wall.

2. A supply air terminal device for a room having a wall between an interior space and outside, said wall having an opening provided therethrough communicating the interior space with outside, there being a radiator disposed in said interior space, in heat exchange relation with said interior space, said supply air terminal device for location between said wall and said radiator, comprising:

a casing;

fastener means for mounting said casing to said wall;

means defining an air inlet opening into said casing, and being arranged to be disposed in communication with said opening through said wall, for admitting air from outside into said casing;

means defining an air outlet opening from said casing for introducing air into said room;

means defining at least one baffled passageway through said casing from said air inlet opening to said air outlet opening; said passageway being arranged to be located in proximity to said radiator, for heating air entering from outside, passing through said passageway and introduced into said room;

attachment means on said casing arranged to engage with said radiator for effectively supporting said radiator via said casing from said wall.

* * * * *